United States Patent [19]

Humbrecht et al.

[11] Patent Number: 5,045,260

[45] Date of Patent: Sep. 3, 1991

[54] POLYESTER YARN AND METHOD FOR ITS MANUFACTURE

[75] Inventors: Remy Humbrecht, Littau; Armin Müller, Emmenbrücke, both of Switzerland

[73] Assignee: Rhone-Poulenc Viscosuisse SA, Emmenbrücke, Switzerland

[21] Appl. No.: 508,907

[22] Filed: Apr. 12, 1990

Related U.S. Application Data

[63] Continuation-in-part of Ser. No. 298,513, Jan. 17, 1989, abandoned, which is a continuation of Ser. No. 29,209, Feb. 11, 1987, abandoned.

[30] Foreign Application Priority Data

Jul. 21, 1985 [CH] Switzerland ..... 02636/85
Jul. 10, 1986 [CH] Switzerland ..... 02330/86

[51] Int. Cl.[5] ..... D01F 6/62

[52] U.S. Cl. ..... 264/103; 264/210.6; 264/210.8; 264/211

[58] Field of Search ..... 264/210.6, 176.1, 211, 264/210.8, 331.21, 103; 528/308.1; 428/364

[56] References Cited

U.S. PATENT DOCUMENTS 3,576,773 4/1971 Vaginay ..... 528/308.1
3,991,013 11/1976 Pletcher ..... 264/331.21
4,070,432 1/1978 Tamaddon ..... 264/342 RE
4,092,299 5/1978 MacLean et al. ..... 264/210.8
4,113,704 9/1978 MacLean et al. ..... 264/210.8

FOREIGN PATENT DOCUMENTS 0182352 5/1986 European Pat. Off. ..... 528/308.1
59-45202 3/1984 Japan ..... 528/308.1
0878125 9/1961 United Kingdom ..... 528/308.1
1325297 8/1973 United Kingdom .

*Primary Examiner*—Hubert C. Lorin
*Attorney, Agent, or Firm*—Michael J. Striker

[57] ABSTRACT

The method for producing dimensionally stable, low-shrinkage, chemically modified industrial polyester yarns by melt spinning at speeds of 1000 to 4000 m/min. utilizes a copolymer containing at least 85 percent by weight polyethylene terephthalate units and comonomers. During polyester production to lower the thermal shrinkage one or more conformationally fixed linear difunctional comonomers are added to the polymer melt. These difunctional comonomers have the general formula, X'—R—X, where R is an unsaturated linear alkyl group having from three to ten carbon atoms or a cycloalkyl or aromatic group with 6 or more carbon atoms, and X and X' are, independently, OR' or CPPR'', and R'=H or an alkyl group and, independently, R'' is also H or an alkyl group.

10 Claims, 1 Drawing Sheet

POLYESTER YARN AND METHOD FOR ITS MANUFACTURE

BACKGROUND OF THE INVENTION

Our invention relates to a polyester yarn and a process for manufacturing it. This application is a continuation-in-part of application Ser. No. 298,513 filed Jan. 17, 1989 and abandoned July 26, 1990, which, in turn, is a continuation of application Ser. No. 029,209, filed Feb. 11, 1987 now abandoned.

The production of shrink-resistant polyester threads, which also have high tensile strength and are stretch-resistant for industrial purposes, is known. Thus, GB-A-1 325 297 describes a method for spinning, stretching and thermofixing in one work cycle. For reduction of the shrinkage up to 1% by weight branching components are incorporated besides thermal fixing. The branching components not only prevent stretching of the threads, but also reduce the strength and the modulus and thus the dimensional stability. In this method, there results a thermal shrinkage of more than 7% , measured at 160° C., with a maximum breaking strength of 80 cN/tex with a titer of approximately 1100 dtex. However, a yarn with such a high tendency toward shrinkage is no longer sufficient for the requirements for the dimensional stability of a tire. In this case, breaking strength, thermal shrinkage and initial modulus of elasticity(Young's modulus of elasticity) must be coordinated with one another within determined limits.

But another method is known for production of chemically modified, quick spun threads (DE-B-1266992). However, in this method only the dyeing properties are characterized by means of the addition of chain branching agents or cross-linking agents such as polyalcohols in quantities of 0.10 to 1.0 moles %.

It has now been found that the dimensional stability of a tire can be expressed by means of a characteristic number if the essential parameters, such as breaking elongation or strength (Ft), initial modulus of elasticity (Mo) and thermal shrinkage (TS), are kept within determined limits. The following characteristic number is suggested for the evaluation of a dimensionally stable yarn with low shrinkage and a high initial modulus of elasticity:

$$DS = \frac{Ft \times Mo}{TS}$$

*Ft* [*cN/tex*]

*Mo* [*cN/tex*]

*TS* [%] measured at 190° C.

It has not been possible thus far to achieve a low shrinkage at a given reference elongation or strength (Ft) and a high initial modulus of elasticity through mechanical/thermal means.

SUMMARY OF THE INVENTION

It is an object of the invention to provide a yarn, especially a high strength industrial yarn, with a high initial modulus of elasticity and a low shrinkage, particularly with a high dimensional stability (DS).

It is also an object of the invention to provide a method for production of an industrial polyester yarn with a high initial modulus of elasticity and a low shrinkage, particularly with a high dimensional stability (DS) greater than 28000 [$cN^2/tex^2$].

These objects and others which will be made more apparent hereinafter are attained in a method for production of dimensionally stable, shrinkage-resistant chemically modified industrial polyester yarn with an intrinsic viscosity of 0.80 to 1.00 dl/g and a total titer of at least 500 dtex comprising melt spinning at speeds of 1000 to 4000 m/min. with the use of a copolymer of at least 85 percent by weight polyethylene terephthalate units and comonomers.

According to our invention this method further comprises the step of adding 1 to 10 percent by weight of one or more of said comonomers selected from the group consisting of linear difunctional comonomers having the general formula:

X'—R—X during polyester production to lower the thermal shrinkage, wherein R is selected from the group consisting of linear alkyl groups having from one, advantageously three, to ten carbon atoms, cycloalkyl radicals with more than six carbon atoms and aromatic radicals with more than six carbon atoms, X and X' are each independently selected from the group consisting of OR' and COOR", wherein R' and R" are each independently selected from the group consisting of H and alkyl groups with one or more carbon atoms, the comonomers being combined chemically with the copolymer.

The linear difunctional comonomers used are advantageously conformationally fixed. By this we mean that their molecular structure(i.e. the position of their atoms) is comparatively fixed in space and various groups cannot freely rotate, pivot or bend and fold relative to each other within determined limits. The linear difunctional comonomers are built into the polymer chain of the product, i.e. they are chemically combined with the copolymer during the formation of the polyester polymer.

The production of the copolyester can be effected in a conventional manner either by means of direct condensation of ethylene glycol and terephthalic acid or by means of transesterification of dimethylterephthalate with ethylene glycol followed by polycondensation of the diglycolterephthalate which is formed first. The comonomer is added to the mixture together with the monomers prior to transesterification or esterification phase or prior to the polycondensation phase. Other diols, such as diethylene glycol, propane- , butane- or hexane diol or cyclohexane-dimethanol, can be additionally added in addition to the ethylene glycol, and other dicarboxylic acids such as isophthalic acid, adipic acid, azelaic acid, dibenzoic acid, dimeric fatty acid, dodecane carboxylic acid. Also the alkyl esters of these acids can be added additionally in addition to the terephthalic acid of the dimethylterephthalate.

The difunctional, conformationally fixed comonomers having only two functional groups have proved particularly suitable for reducing the thermal shrinkage and for simultaneously increasing the dimensional stability, DS.

These difunctional compounds must be used in concentrations of 1 to 10 percent by weight, with reference to the polyester. Representatives of such compounds are 2-methyl-2-butene-1,4-diol and 2,3-dimethyl-2-butene-1,4-diol or other unsaturated aliphatic diols such as cis- or trans-2-butene-1,4-diol and their derivatives such as 1,4-diacetoxy-butene-2 or unsaturated aliphatic hydroxycarboxylic acids such as 4-hydroxycrotonic acid or their derivatives such as 4-hydroxycrotonic acid methyl ester and 4-acetoxycrotonic acid methyl ester.

Also particularly suitable as comonomers are the conformationally fixed aromatic diols such as hydroquinone, 2-chlorohydroquinone, 2,3,5-trichlorohydroquinone, 2,5-dichlorohydroquinone, 2-methylhydroquinone, 2,3-dimethylhydroquinone, 2,5-dimethylhydroquinone, 2,3,5-trimethylhydroquinone, 2,3,5,6-tetramethylhydroquinone, 4,4'-dihydroxybiphenyl, 2,6-naphthalene diol, 1,5-naphthalene diol or their derivatives such as hydroquinone diacetate, 2-chlorohydroquinone diacetate, 2,3,5-trichlorohydroquinone diacetate, 2-methylhydroquinone diacetate, 2,5-dimethyloxyhydroquinone diacetate, 2,3,5-trimethylhydroquinone diacetate, 4,4'-diacetoxybiphenyl, 2,6-diacetoxynaphthalene and 1,5-diacetaoxynaphthalene.

Aromatic hydroxycarboxylic acids such as 4-hydroxybenzoic acid, 6-hydroxy-2-naphthoic acid, 5-hydroxy-1-naphthoic acid, particularly acetyl compounds and alkyl esters such as 4-hydroxybenzoic acid methyl ester, 6-hydroxy-2-naphthoic acid methyl ester, 4-acetoxybenzoic acid, can be used according to the invention.

Of the difunctional rigid and aromatic comonomers, hydroquinone diacetate or 4-acetoxybenzoic acid have proven to be the best.

The polyester yarn produced according to the method of the invention is characterized by a characteristic number DS of >28000. It is assumed that Ft ranges between the limits of 50 cN/tex and 80 cN/tex, preferably from 60 cN/tex to 80 cN/tex. At the same time, a Young's modulus of elasticity of 1000 cN/tex to 1400 cN/tex, preferably 1200 cN/tex to 1300 cN/tex, is stipulated, as well as a thermal shrinkage TS of 1 to 5%, preferably <3%.

The method of the invention is explained in more detail with the aid of examples without being limited to the details included therein.

Polyester is to be understood as a polymer of at least 85 percent by weight terephthalate and ethylene glycol units. In order to produce the copolyester, 6.1 kg ethylene glycol and 10 kg dimethyl terephthalate, as well as the comonomer, according to the invention, are placed in an autoclave. 4 g crystallized manganese acetate is added as a transesterification catalyst. The mixture is heated to 230° C. for 2.5 hours, whereby the nascent methanol and the glycol excess are distilled off under normal pressure. The following substances are added one after the other at 230° C.: 3 g phosphorous acid and 3.5 g antimony trioxide. The pressure is reduced to below 0.5 mbar during heating to 280° C. The comonomer can also be added directly to the polymer melt prior to the vacuum phase. The vacuum is broken by means of introducing nitrogen after 3.5 to 5 hours, depending on the type of comonomer, the polymer melt is removed from the autoclave, for example, in cable form, it is cooled and the solidified polymer is cut. The limit viscosity, measured at 25° C. in a mixture of phenol/tetrachloroethane in a ratio of 1:1 (according to H. Frind, Fiber Research(1954), page 296), amounts to approximately 0.67 dl/g. The granulate is then first dried in a tumbling dryer in a vacuum of 0.5 mbar for 2 hours at 150° C., then subjected to post-condensation and dry-supported for several hours at 235° C. to an IV which lies between 0.80 and 1.02. The post-condensation period depends on the type of comonomer and on the achievable vacuum and amounts to up to 30 hours.

For the purpose of spinning, the dry granulate is processed on a known spinning machine for the processing of high-viscosity polyesters and the stretching of high-tensile strength multiple-filament yarns. The polyester which is melted at a temperature of approximately 285° to 310° C. is pressed out of the spinneret with e.g. 192 continuous filaments in a known manner, uniformly cooled, converted, provided with a preparation and wound up or directly stretched.

The unstretched yarn is repeatedly stretched and spooled on hot aggregates in several stages. The spinning and, in particular, the stretching can be effected in an integrated manner or in the split process at various speeds. The transmission of heat during the stretching is effected by means of pressing irons, hot rolls or an oven, where the thread is oriented in a crystallized manner and fixed. The longitudinal tensioning under which the thread material is kept suffices to prevent shrinkage during each stage of the heat treatment and to bring about a repeated stretching. During this process a breaking strength of at least 65 cN/tex is imparted to the thread material and the breaking elongation, measured at 25° C. at the conditioned thread at an elongation rate of 2.7% D/s, amounts to 8 to 15%, preferably 9 to 12%.

In the copolyester, according to the invention, the thermal shrinkage (TS) is 1 to 5% (measured at 190° C.). The shrinkage values were determined with the aid of a thermomechanical analyzer(thermofil device by TEXTECHNO/Moenchengladbach). The thread is first processed beforehand with a pretensioning of 0.4 cN/dtex for 1 minute at 235° C. and the shrinkage of the cooled thread then follows at a heating rate of 20 K/min. The tensioning length or distance between the grips is 10 cm and the shrinkage value is determined from the curve at the desired temperature, e.g. 190° C.

The modulus of elasticity is determined from the slope of the force-elongation curve in the initial area as follows:

The filament is elongated at a rate of 2.5 cm/min with a force elongation measurement device (ZWICK company, type 1474) at a tensioning length or distance between the grips of 500 mm and the force is recorded until it reaches 2 cN. In this range the force-elongation function (with the exception of every small starting piece) runs in a very linear manner with the filaments according to the invention. A tangent is then constructed on the curve and the force, which is extrapolated to 100% elongation, is calculated from the slope. This force value, which is divided by the titer of the filament bundle, is taken as initial modulus of elasticity [cN/dtex] or [cN/tex].

EXAMPLES

Example 1

300 g hydroquinone diacetate (3 percent by weight with reference to the polyester) was used as comonomer together with the other two educts, ethylene glycol and dimethyl terephthalate. The rest of the conditions corresponded to the above-described general procedure After a transesterification period of 2 hours, 6.3 l methanol developed and after another 30 minutes 1.1 l glycol developed. The following polycondensation lasted 4 hours, 50 minutes, wherein the copolyester has a IV of 0.70 dl/g and a melting point of 254° C. After an post-condensation of 28 hours at 235° C., a IV of 0.90 dl/g was reached..

Some characteristics of the resulting yarn are shown in Table 1, wherein a model thread with 14 fibrils was produced.

Example 2

300 g 4-acetoxybenzoic acid was used as comonomer in the same manner as in Example 1. After 2 hours, 3.7 l methanol resulted and, after another 30 minutes, 1.1 l glycol resulted. After 4 hours, 30 minutes, the IV reached 0.65 dl/g and the melting point amounted to 248° C. After a post-condensation of 28 hours a IV of 0.80 dl/g was reached. The Table shows the yarn characteristics.

Example 3

100 g 2-butene-1,4-diol was added as comonomer in the same manner as in Example 1. After 2.5 hours, 3.7 l methanol was released, and after another 30 minutes another 1.5 l glycol was released. The polycondensation lasted 4 hours and a IV of 0.68 dl/g and a melting point of 253° C. were achieved. After an post-condensation of 28 hours the IV amounted to 0.97 dl/g.

Example 4

The procedure corresponds to that of example 2 but without added comonomer. After 2 hours, 3.4 l methanol developed and after another 30 minutes 1 l glycol developed. The polycondensation lasted 3 hours, 50 minutes. The polymer had a IV of 0.70 dl/g and a melting point of 225° C. After an post-condensation of 25 hours, the IV amounted to 0.99 dl/g. The characteristics of the yarns are shown in Table 1.

TABLE 1

| Example | Spinning Velocity (m/min) | IV of thread (dl/g) | Stretching Ratio | Breaking Elongation (%) | Titer (dtex) | Ft (cN/tex) | Mo (cN/tex) | TS (%) | DS ($cN^2/tex^2$) | Birefringence ($10^{-2}$) |
|---|---|---|---|---|---|---|---|---|---|---|
| 1 | 600 | 0.69 | 5.26 | 10.8 | 81.3 | 73.3 | 1370 | 4.00 | 25100 | 201.4 |
| | 1000 | 0.73 | 4.25 | 10.5 | 84.8 | 68.8 | 1280 | 3.05 | 28875 | 193.4 |
| | 2000 | 0.79 | 2.77 | 10.4 | 82.0 | 65.9 | 1250 | 2.80 | 29420 | 186.3 |
| | 3000 | 0.82 | 2.15 | 11.8 | 76.3 | 63.3 | 1260 | 2.15 | 37100 | 182.7 |
| | 4000 | 0.83 | 1.81 | 11.2 | 71.5 | 52.3 | 1280 | 2.15 | 31135 | 175.2 |
| 2 | 600 | 0.75 | 5.15 | 11.2 | 84.8 | 67.5 | 1360 | 4.20 | 21855 | 196.8 |
| | 1000 | 0.76 | 4.25 | 11.0 | 84.9 | 63.5 | 1300 | 3.60 | 22860 | 189.3 |
| | 2000 | 0.77 | 2.83 | 11.0 | 81.4 | 63.4 | 1260 | 3.05 | 26190 | 183.7 |
| | 3000 | 0.79 | 2.10 | 11.9 | 77.8 | 65.5 | 1290 | 1.75 | 48280 | 184.0 |
| | 4000 | 0.79 | 1.75 | 11.5 | 74.9 | 62.8 | 1340 | 2.35 | 35810 | 181.9 |
| 3 | 600 | 0.74 | 5.26 | 10.6 | 80.3 | 71.0 | 1460 | 4.35 | 23830 | 196.3 |
| | 1000 | 0.82 | 4.14 | 11.0 | 87.0 | 64.5 | 1290 | 3.65 | 22800 | 190.1 |
| | 2000 | 0.83 | 2.67 | 11.8 | 85.0 | 62.9 | 1250 | 3.20 | 24570 | 180.5 |
| | 3000 | 0.85 | 2.19 | 10.5 | 74.4 | 60.5 | 1310 | 2.40 | 33020 | 182.1 |
| | 4000 | 0.84 | 1.80 | 11.2 | 68.8 | 37.8 | 1240 | 2.35 | 19950 | 165.6 |
| 4 | 600 | 0.77 | 5.90 | 22.5 | 83.2 | 72.9 | 860 | 2.90 | 21620 | 184.0 |
| | 2700 | 0.92 | 2.50 | 11.1 | 82.3 | 67.0 | 1280 | 3.00 | 28590 | 180.5 |
| | 3400 | 0.89 | 2.10 | 9.0 | 79.6 | 68.3 | 1220 | 2.90 | 28730 | 183.0 |

BRIEF DESCRIPTION OF THE DRAWING

The measurement results of the examples are shown in the curves in the sole figure of the drawing. The ordinate is the dimensional stability, with the dimension $cN^2/tex^2$, and the abscissa is the spinning rates in m/min.

The polyester of Example 2 has the best dimensional stability, 48280 $cN^2/tex^2$, with a thermal shrinkage of 1.75% with the spinning speed of 3000 m/min.

Figure 1:
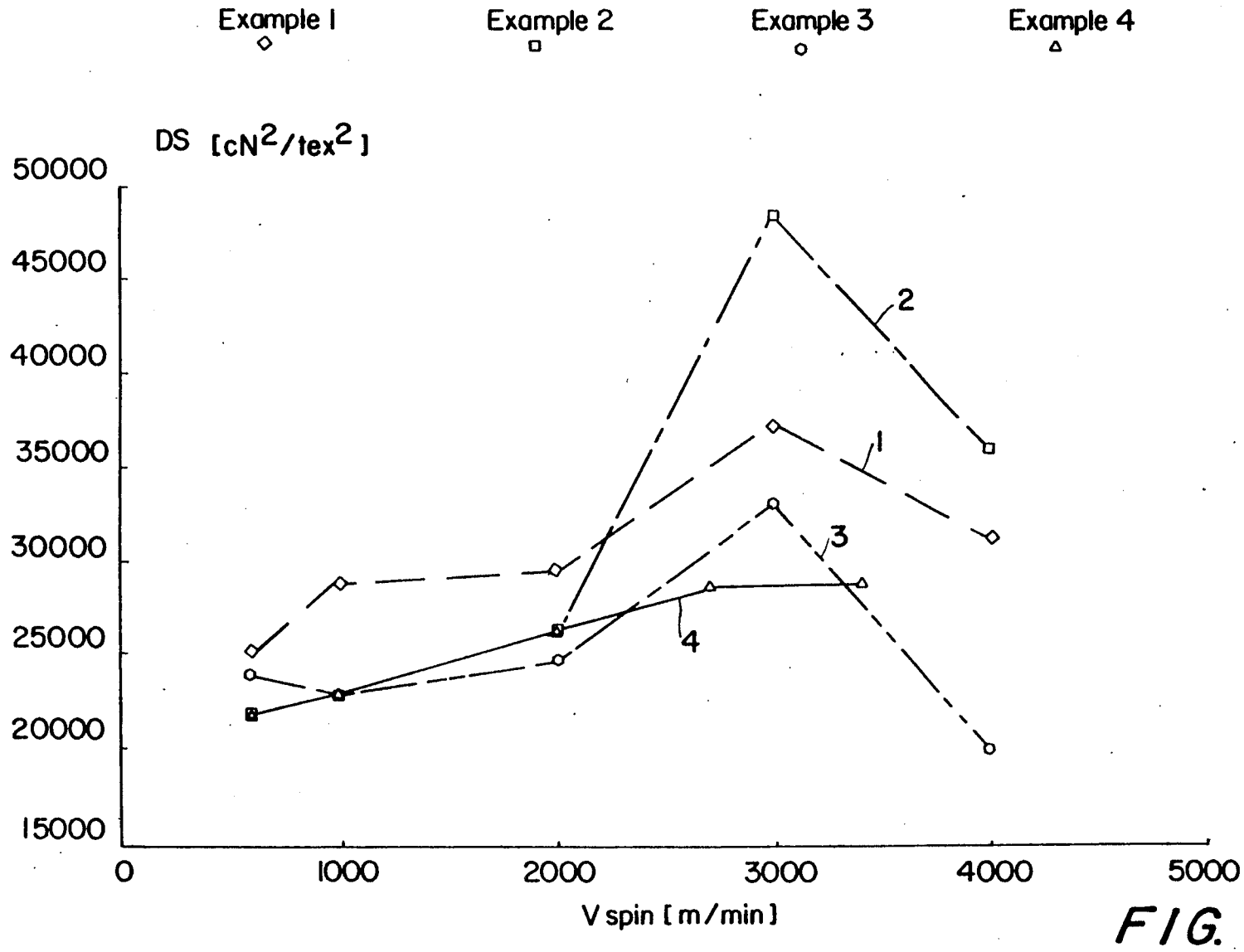

The yarns produced according to the method, according to the invention, are used in a preferred manner as yarns with low shrinkage and high Young's modulus of elasticity(LSHM) for production of woven tire cord fabrics and other industrial uses, such as for drive belts and safety belts.

While the invention has been illustrated and described as embodied in a polyester yarn and method of its manufacture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In a method for production of dimensionally stable, shrinkage-resistant, chemically modified industrial polyester yarns by melt spinning at speeds of 2000 to 4000 m/min., with the use of a copolymer containing at least 85 percent by weight polyethylene terephthalate units and comonomers, with an intrinsic viscosity of 0.80 to 1.00 dl/g and a total titer of at least 500 dtex, the improvement comprising adding 1 to 10 percent by weight of one or more comonomers selected from the group consisting of linear difunctional comonomers having the general formula:

$$X'—R—X$$

during the polyester production to lower thermal shrinkage, said linear difunctional comonomers being combined chemically with said copolymer, wherein R is selected from the group consisting of linear alkyl groups having from one to ten carbon atoms, cycloalkyl radicals with more than six carbon atoms and aromatic radicals with more than six carbon atoms, X is selected from the group consisting of OR' and COOR'', X' is selected independently from the group consisting of OR' and COOR'', and R' and R'' are each independently selected from the group consisting of H and alkyl groups.

2. The method according to claim 1, wherein said linear difunctional comonomers are conformationally fixed.

3. The method according to claim 1, wherein said comonomers are added in a polymerization melt prior to polycondensation.

4. The method according to claim 1, wherein said comonomers are selected from the group consisting of unsaturated aliphatic diols, derivatives of said unsaturated aliphatic diols, unsaturated aliphatic hydroxycarboxylic acids and derivatives of said unsaturated aliphatic hydroxycarboxylic acids.

5. The method according to claim 4, wherein said unsaturated aliphatic diol is 2-butene-1,4-diol.

6. The method according to claim 1, wherein said comonomers are selected from the group consisting of aromatic diols, derivatives of said aromatic diols, aromatic hydroxycarboxylic acids and derivatives of said aromatic hydroxycarboxylic acids.

7. The method according to claim 6, wherein said derivatives are alkyl esters.

8. The method according to claim 6, wherein said derivatives are acetyl derivatives.

9. The method according to claim 8, wherein said acetyl derivative is selected from the group consisting of hydroquinone diacetate and 4-acetoxybenzoic acid methyl ester.

10. The method according to claim 1, wherein R is selected from the group consisting of three to ten carbon atoms and aromatic groups with six or more carbon atoms.

* * * * *